United States Patent [19]

Auboir et al.

[11] 4,395,330

[45] Jul. 26, 1983

[54] PROCESS FOR SOLVENT DEASPHALTING OF RESIDUAL HYDROCARBON OILS

[75] Inventors: Pierre Auboir; Pierre Bonnefond, both of Rueil-Malmaison; Larry Mank, Orgeval, all of France

[73] Assignee: Institut Francais du Petrole, Rueil-Malmaison, France

[21] Appl. No.: 325,254

[22] Filed: Nov. 27, 1981

[30] Foreign Application Priority Data

Nov. 28, 1980 [FR] France ..... 80 25405

[51] Int. Cl.[3] ..... C10C 3/00; C10C 3/08

[52] U.S. Cl. ..... 208/309; 208/086

[58] Field of Search ..... 208/309, 086

[56] References Cited

U.S. PATENT DOCUMENTS

| | | | |
|---|---|---|---|
| 2,240,008 | 4/1941 | Atwell | 208/86 |
| 2,611,737 | 9/1952 | Johnson | 208/86 |
| 2,770,576 | 11/1956 | Pratt | 208/86 |
| 2,847,353 | 8/1958 | Beavon | 208/309 |
| 2,850,431 | 9/1958 | Smith | 208/86 |
| 2,943,050 | 6/1960 | Beavon | 208/309 |
| 3,423,308 | 1/1969 | Murphy | 208/251 R |
| 3,627,645 | 12/1971 | Dittman | 196/14.52 |
| 3,972,807 | 8/1976 | Uitti et al. | 208/86 |
| 4,017,383 | 4/1977 | Beavon | 208/309 |

FOREIGN PATENT DOCUMENTS

| | | | |
|---|---|---|---|
| 512043 | 4/1955 | Canada | 208/309 |
| 1131723 | of 0000 | United Kingdom . | |

*Primary Examiner*—Delbert E. Gantz
*Assistant Examiner*—Helane E. Maull
*Attorney, Agent, or Firm*—Millen & White

[57] ABSTRACT

An asphaltene-containing residual hydrocarbon oil is deasphalted by means of a light hydrocarbon solvent. Heating of the resultant asphaltic phase for solvent removal is effected by heat exchange with the deasphalted oil previously subjected to sufficient heating in a furnace heated by flame. Fouling of the plant is thus avoided.

8 Claims, 1 Drawing Figure

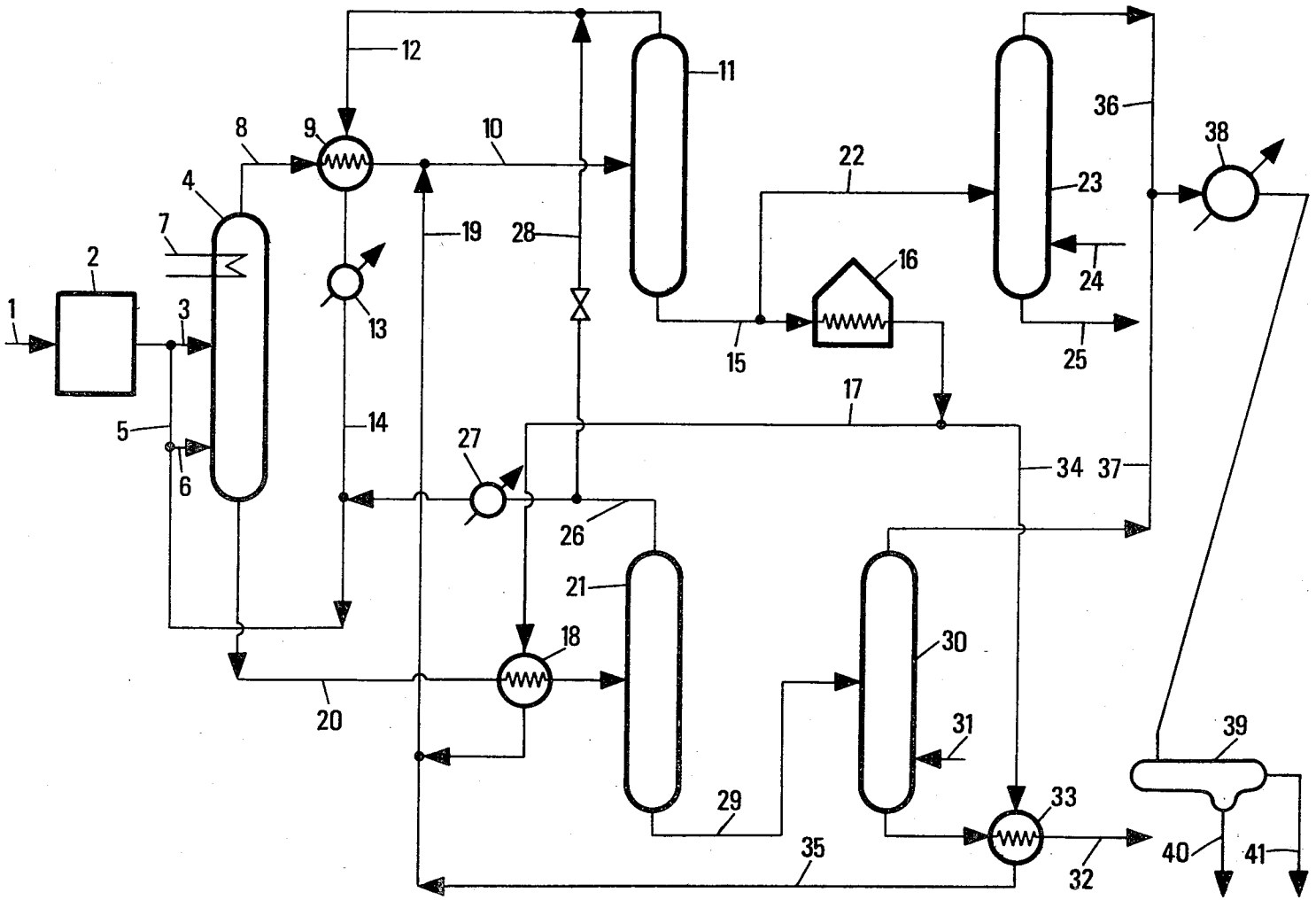
1
2
3
4
5
6
7
8
9
10
11
12
13
14
15
16
17
18
19
20
21
22
23
24
25
26
27
28
29
30
31
32
33
34
35
36
37
38
39
40
41

PROCESS FOR SOLVENT DEASPHALTING OF RESIDUAL HYDROCARBON OILS

BACKGROUND OF THE INVENTION

This invention concerns the deasphalting of residual hydrocarbon oils, such as oil distillation residues, residues from shale oils or bituminous shales or heavy products from destructive distillation or from coal hydrogenation.

Residual hydrocarbon oils, which contain asphaltic materials, cannot be directly subjected to such treatments as hydrodesulfurization, hydrocracking or catalytic cracking in view of their excessive asphalt and metals content.

It has thus been proposed to subject them to a prior deasphalting treatment with a solvent selected from the saturated or olefinic aliphatic hydrocarbons of low molecular weight.

It is known that the yield of deasphalted oil is higher when the hydrocarbon used as solvent has a greater number of carbon atoms, with however two disadvantages: first, this increased yield is obtained with a simultaneous reduction of the oil purity, particularly its metal content; and second, the heavier the solvent, the harder and the less fusible the resultant asphalt.

Consequently, for practical reasons and although the use of hydrocarbons with 3 to 7 carbon atoms has been proposed, most of the known plants operate with $C_3$, $C_4$, mixtures of $C_3+C_4$ and, in a reduced number of cases, $C_5$ hydrocarbons.

A difficulty to overcome is the treatment of the asphaltic phase rejected in the course of the deasphalting. This phase comprises a substantial proportion of extraction solvent and must be separated from the latter. This is commonly obtained by vaporizing the solvent and/or stripping with an inert gas such as nitrogen or steam; the vaporization of the solvent requires supplying an important amount of heat to the asphaltic phase.

In the known plants, the asphaltic phase is passed through a furnace heated with a flame (U.S. Pat. Nos. 2,943,050; 3,423,308 and 4,017,383) although steam can be used for propane and some light mixtures of propane with butane (U.S. Pat. No. 3,627,675).

It is clear that the heavier the solvent, and the higher the temperature of the furnace, although the temperature is limited by the tendency of the solvent to decompose when contacted with the walls of the furnace. Asphalt is considered to decompose at from 310° to 330° C. However, it is difficult to control the temperature of the furnace walls. Not only is the temperature not the same in all parts of the furnace, but also the optimum temperature varies in the course of time, depending on the nature, itself variable, of the feed charge to reheat.

The decomposition of the asphalt results in deposition of scale which interferes with good heat transmission and requires further heating which further increases the number of hot points; the clogging of the ducts can even necessitate stopping the operation.

This disadvantage occurs even with butane, but it is particularly important when using a hydrocarbon with 5 to 7 carbon atoms, inasmuch as the resultant asphalt is more and more viscous.

The object of the present invention is to describe a deasphalting (demetallization) process which obviates the above drawbacks and thus allows the treatment, without fouling difficulty and over long periods, of residual hydrocarbon oils by means of hydrocarbons having from 4 to 7 carbon atoms, for example, isobutane, n-butane, neo-pentane, n-pentane, isohexane or $C_4$, $C_5$ and $C_6$ cuts.

SUMMARY OF THE INVENTION

The process comprises contacting the hydrocarbon charge to be deasphalted with a light hydrocarbon solvent in an extraction (or mere mixing) zone, the amount of solvent, the temperature and the pressure being so selected as to allow the formation of 2 distinct phases: a liquid mixture of solvent with deasphalted oil and a fluid mixture of solvent with asphaltic oil; the resultant phases are separated from each other, for example by settling, and the solvent is separated thereafter from each phase by vaporizing, thus allowing recycle thereof. The process is so characterized that a portion of the deasphalted oil, substantially freed of solvent, is passed in a zone of indirect heating by flame, so as to raise its temperature, it is thereafter contacted, in heat exchange relation, with the solvent-asphaltic oil mixture, so as to deliver to the latter at least part of the heat required for vaporizing the solvent contained therein and it is finally admixed with the solvent-deasphalted oil mixture discharged from the extraction zone to which it delivers additional heat for vaporizing the solvent.

BRIEF DESCRIPTION OF THE DRAWING

The drawing is a schematic diagram of one embodiment of the present process.

DETAILED DISCUSSION

According to a preferred embodiment, the solvent vapor, separated from the deasphalted oil by vaporization, is contacted in heat exchange relation with the solvent-deasphalted oil mixture before adding thereto the deasphalted oil which delivers the mentioned additional heat.

The operating conditions of the deasphalting are well-known and will be only briefly mentioned: the ratio by volume of the light hydrocarbon to the oil to be deasphalted is normally from 2 to 12, preferably from 3 to 5. The temperature depends on the light hydrocarbon which is used and is normally between 70° and 220° C. For example, with pentane, the temperature is normally selected between 170° and 210° C., for example 205° C. at the top and 195° C. at the bottom.

The temperature to which the deasphalted oil can be brought in the zone of indirect heating by flame can be relatively high, for example 250° to 420° C., preferably 350° to 400° C., without serious risk of fouling of said zone, as a result of the low asphaltene content of the oil.

Since this oil is thereafter fed back upstream of the vaporization zone for the solvent admixed with the deasphalted oil, it is easy to control the amount of heat delivered to the asphaltic phase, in the exchange zone, by mere control of the oil supply.

According to a modified embodiment, a part of the deasphalted oil, heated by flame, can be used to reheat the asphalt when discharged from the vaporizer(s).

The invention is illustrated by the drawing.

The asphaltene containing hydrocarbon charge (duct 1) is received in the intermediary storage vessel 2, and then fed through duct 3 into column 4, after adddition of light hydrocarbon from duct 5. When desired, another portion of the light hydrocarbon is fed at the bottom of column 4 through duct 6. This supply system is conventional as is reheating through exchanger 7 at the top of the column; an interface forms in the column. A mixture of light hydrocarbon and deasphalted oil is discharged through duct 8 and is passed through exchanger 9 and line 10 to feed the vaporization column 11. The vapor of light hydrocarbon is recycled to the ducts 5 and 6 through line 12, exchanger 9, condenser 13 and duct 14. The deasphalted oil is discharged from column 11 through duct 15. A portion of this oil passes through furnace 16, duct 17, exchanger 18 and line 19 to meet duct 10. In exchanger 18, it delivers heat to the asphalt-light hydrocarbon mixture which leaves column 14 through duct 20 to be fed to the vaporization column 21. Another portion of deasphalted oil is fed through duct 22 to the stripping column 23 where it is treated with a stream of steam (duct 24). The deasphalted oil is thus freed from the last traces of light hydrocarbon and is discharged through line 25.

In the vaporization column 21, a vapor phase of light hydrocarbon is obtained; it is fed to line 14 after passage through duct 26 and condenser 27. It can also be fed, if desired, totally or partly, to line 12 through duct 28 to recover heat therefrom in exchanger 9. Asphalt is discharged from column 21 through line 29 and is fed to the stripping column 30 to be made free of the last traces of light hydrocarbon by means of a stream of steam admitted through line 31. Asphalt is discharged through line 32; it can be reheated, for fluidization thereof, by passage through exchanger 33 fed with a portion of the deasphalted oil discharged from furnace 16; this oil passes through line 34, exchanger 33 and line 35.

Vaporized mixtures of water and light hydrocarbon are obtained at the top of the columns 23 and 30. These mixtures can be treated as such or separately; in the first case, taken as an example, the mixture flowing through duct 36 is joined to the mixture flowing through line 37 before passing through condenser 38 and settler 39. Water is discharged through line 40 and light hydrocarbon through line 41. The latter can be recycled to the plant through a duct, not represented.

A number of modifications can be made in the above embodiment without modifying the purpose thereof. For example, the light hydrocarbon can be removed, either from the deasphalted oil or from the asphalt, in a single column, for example column 11 for the deasphalted oil and column 21 for the asphalt. In that case, the columns 23 and/or 30 are not used. It is also possible, in that case, to strip with steam or with an inert gas in the single column, thus in columns 11 and 21.

In the drawing, the compressors, pressure-reducers and pumps have not been represented for the sake of simplicity. It is clear, however, that the deasphalting is effected, in known manner, under pressure, in order to maintain the light hydrocarbon in liquid phase at the operative temperature. It is advantageous to subject the effluents from deasphalting to a pressure release, in order to facilitate the evaporation of the solvent.

EXAMPLE

The operation conforms to the scheme illustrated by the drawing.

The hydrocarbon charge consists of a vacuum residue whose properties are given in the Table.

The hydrocarbon charge is treated with n-pentane in a pentane/hydrocarbon volumic ratio of 4, at a temperature of about 175° C. at the bottom and 195° C. at the top. The top effluent (deasphalted oil+solvent) is subjected to pressure release and is fed to exchanger 9 for reheating. The vaporized solvent is discharged from the top of the drum 11 and is passed through exchanger 9. The liquid phase of deasphalted oil is discharged at 250° C. A portion thereof is discharged from the plant after treatment with steam (23). Another portion is passed through furnace 16, heated with fuel oil, where it is brought to 330°–380° C., then through exchanger 18 where it raises the temperature of the asphaltic phase from about 150° C. to about 300° C. The heated asphaltic phase is subjected to vaporization, after pressure release, so as to recover the solvent. Asphalt is steam-stripped, to remove the traces of solvent, and then discharged at a temperature of about 300° C. after reheating by means of a portion of the deasphalted oil recovered from furnace 16.

After 6 months of operation, the exchanger 18 was inspected. A tarry coating of low thickness had formed, but the heat-conduction properties had not been modified substantially. The furnace used for heating the deasphalted oil had not been fouled.

TABLE

| | VACUUM RESIDUE | DEASPHALTED OIL |
|---|---|---|
| Specific gravity (g/cm$^3$) | 1.046 | 0.987 |
| Conradson carbon (% b.w.) | 26.5 | 12 |
| Asphaltenes (heptane insol., % b.w.) | 8.7 | 0.05 |
| Viscosity at 100° C. (m$^2$/s) | $80 \times 10^{-4}$ | $2.4 \times 10^{-4}$ |
| Ni (ppm b.w.) | 35 | 15 |
| V (ppm b.w.) | 150 | 40 |

By way of comparison, a practically identical deasphalting unit, except that the exchanger 18 had been replaced with a furnace heated with fuel oil, was stopped after only 3 months of operation, due to an excessive pressure drop in the furnace. An inspection of the latter showed very hard infusible scale at hot points of the tubes.

What is claimed is:

1. In a process for solvent deasphalting an asphaltene-containing residual hydrocarbon oil, wherein the residual oil is contacted with a light hydrocarbon solvent, in an extraction zone, deasphalting conditions are maintained to allow the formation of a liquid solvent-deasphalted oil phase and a fluid solvent-asphalt phase, the two resultant phases are separated and the solvent is separately vaporized from each of the two phases, so as to separately obtain a deasphalted oil and an asphaltic residue, the improvement comprising:

a. passing a portion of the deasphalted oil, substantially freed of solvent, through a zone of indirect heating by flame, so as to raise its temperature;

b. contacting the reheated deasphalted oil from step (a), in indirect heat exchange relation, with the fluid solvent-asphalt phase, so as to deliver to said phase at least a part of the heat necessaary to vaporize the solvent therein; and c. admixing the deasphalted oil, after the heat exchanger of step (b), with the liquid solvent-deasphalted oil phase recovered from the extraction zone.

2. A process according to claim 1, wherein a portion of the reheated deasphalted oil from step (a) is contacted, in indirect heat exchange relation, with the asphaltic residue, so as to reheat said residue and make it more fluid.

3. A process according to claim 1, wherein the temperature of the deasphalted oil is raised to 250°–420° C. in step (a).

4. A process according to claim 1, wherein the temperature of the deasphalted oil is raised to 350°–400° C. in step (a).

5. A process according to claim 1, wherein the solvent vapor separated from the deasphalted oil is contacted, in heat exchange portion, with the liquid solvent-deasphalted oil phase before subjecting the latter to the mixing of step (c).

6. A process according to claim 1, wherein the solvent is selected from the aliphatic hydrocarbons with 4 to 7 carbon atoms.

7. A process according to claim 1, wherein the solvent is selected from the aliphatic hydrocarbons with 5 to 7 carbon atoms.

8. A process according to claim 1, wherein the feed rate of the deasphalted oil supplied to step (a) is controlled according to the heat amount to be delivered to the fluid solvent-asphaltic oil phase.

* * * * *